United States Patent [19]

Gallagher et al.

[11] Patent Number: 4,519,155

[45] Date of Patent: May 28, 1985

[54] IDENTIFICATION CARD

[75] Inventors: Terence J. Gallagher, Brookfield, Conn.; Anthony LaCapria, Brooklyn, N.Y.

[73] Assignee: American Bank Note Company, New York, N.Y.

[21] Appl. No.: 491,950

[22] PCT Filed: Aug. 17, 1981

[86] PCT No.: PCT/US81/01110

§ 371 Date: Apr. 17, 1983

§ 102(e) Date: Apr. 17, 1983

[51] Int. Cl.[3] ..... G09F 3/02

[52] U.S. Cl. ..... 40/625; 40/626; 428/203; 428/204; 428/209; 283/109; 283/904

[58] Field of Search ..... 428/203, 334, 283, 201, 428/204, 212, 209; 283/109, 904; 40/626, 625, 630, 615

[56] References Cited

U.S. PATENT DOCUMENTS

| | | | |
|---|---|---|---|
| 3,442,740 | 5/1969 | David | 156/181 |
| 3,716,439 | 2/1973 | Maeda | 283/109 |
| 3,725,184 | 4/1973 | Scopp | 428/203 |
| 3,902,262 | 9/1975 | Colegrove et al. | 283/904 |
| 4,133,926 | 1/1979 | Vorrier et al. | 428/203 |
| 4,158,079 | 6/1979 | Severus-Laubenfeld | 428/334 |
| 4,247,318 | 1/1981 | Lee et al. | 428/283 |
| 4,343,851 | 10/1982 | Sheptak | 428/203 |

*Primary Examiner*—Gene Mancene

*Assistant Examiner*—James Hakomaki

[57] ABSTRACT

A security document such as an identification card including a base layer having at least one surface bonded and security markings printed on that surface. The bonded surface is covered by a protective layer including a film of material fused thereto so as to form a matrix encapsulating the printed security markings (which may include a xerographically reproduced photograph).

20 Claims, 7 Drawing Figures

IDENTIFICATION CARD

BRIEF SUMMARY OF THE INVENTION

This invention is an identification card or other security document wherein it is desired to prevent access to markings on the document to protect them from erasure and changes. The invention also includes a method of making such a document.

Lee et al., U.S. Pat. No. 4,247,318 proposes to make a security document by assembling two unbonded polyethylene film-fibril sheets with security material such as threads between them, and then bonding the sheets to form a laminated document in which the security material is protected. Although Lee et al suggest the use of "printing on an inner plane of the paper" as a possible security material, the unbonded sheets proposed by Lee et al. do not accept printing well.

According to the preferred embodiment of the present invention, a bonded polyethylene film-fibril sheet is used as the base sheet. Such a bonded sheet accepts printing with conventional inks on one or both sides, and is in fact receptive to all common recording materials, including pencil and xerographic toners. After the base sheet is marked, by printing or otherwise, it is covered, preferably on both sides, by the application of a protective sheet of Mylar (polyethylene terephthalate) coated on its side nearest the base sheet with a layer of polyethylene film. The assembly is then fused together, for example by the application of heat and pressure in a pair of calender rolls. This fuses the bonded polyethylene of the base sheet with the polyethylene film, forming a matrix which encloses the printing or other indicia that have been deposited on the base sheet. This matrix is less subject to delamination than is the base sheet itself, whose internal structure between the bonded surfaces comprise fibers which are bonded together only at spaced intervals. Attempts to delaminate a card or document constructed in accordance with the present invention will result in a splitting of the base sheet, while the printing or other markings contained within the fused matrix remain intact.

The manufacture of nonwoven film-fibril sheets is disclosed in detail in the U.S. Patents to Steuber, U.S. Pat. Nos. 3,169,899 and David, 3,442,740, both of which are incorporated herein by reference.

As described in the David patent #3,442,740, such sheets consist of randomly overlapping continuous strands, each strand being a three-dimensional network of film-fibrils interconnected at random intervals along and across the strand, said film-fibrils at the surfaces of the sheet being well fused and of high density, while the film-fibrils in the internal structure of the sheet are partially fused and of lower density. If the film-fibril sheet is so constructed, any attempt to delaminate the document results in a destruction of the base sheet without allowing access to the printing or other markings.

Although the presently preferred embodiment of the invention employs a polyethylene film-fibril sheet as the base sheet and a polyethylene film as the material which covers the marked base sheet, it is not necessary that the materials for those sheets be polyethylene, nor that the base sheet be a film-fibril sheet. It is necessary that the base sheet be of a material which will accept a marking, and that the base sheet and the covering sheet be thermoplastic and compatible and that they have melting temperature ranges which overlap so that the covering sheet can fuse with the surface of the base sheet to form a matrix enclosing the marking. The two materials need not be the same.

While the preferred material for the protective sheet is Mylar, other suitable strong and abrasion resistant materials may be employed.

DRAWINGS

DETAILED DESCRIPTION

Figure 1:
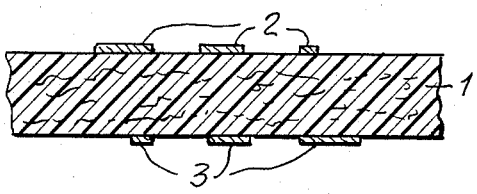
FIG. 1 is a cross-sectional view, on an enlarged scale, of a base sheet with printing thereon in accordance with a first step of the method according to the invention.

Referring to FIG. 1, there is shown a base sheet 1 on which there has been applied a set of markings 2 by printing or other suitable process. Another set of markings 3 appears on the under surface of the sheet 1. Preferably the base sheet 1 is a bonded polyethylene film-fibril sheet. Other materials than polyethylene may be used. The film-fibril structure is not essential. The surface or surfaces to be printed must be bonded.

Figure 2:
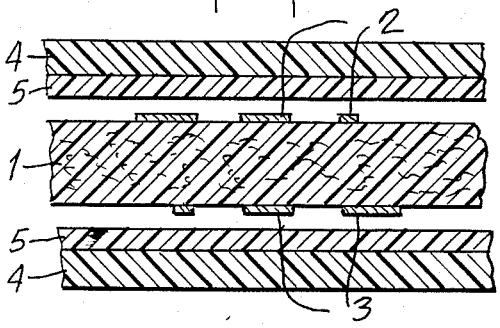
FIG. 2 is a similar cross-sectional view showing protective sheets brought into position adjacent the base sheet of FIG. 1.

In FIG. 2, there is positioned above the sheet 1 a protective sheet preferably consisting of a layer 4 of Mylar (polyethylene terephthalate) on the under side of which is bonded a layer of polyethylene film. Similar layers 4 and 5 are located under the base sheet 1. Such laminations of Mylar and polyethylene are readily available commercially.

Figure 3:
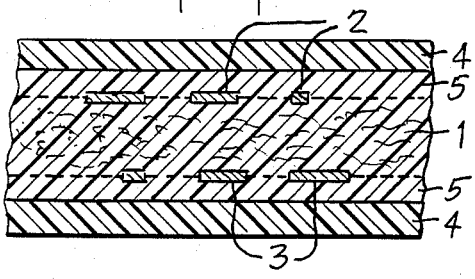
FIG. 3 is a similar cross-sectional view of a complete document after the compression and fusion of the sheets has been accomplished.

In FIG. 3, the several layers shown in FIG. 2 have been assembled by forcing them together either under heat and pressure or by the application of energy through a laser beam. The heat and pressure may be applied by a press or by a pair of heated rollers between which the assembly is fed. During this step the bonded surfaces of the base sheet are fused with the adjacent polyethylene films to form matrices which encapsulate the ink or other markings. The temperature should be within the melting ranges of both the materials which are in contact. The pressure is not critical. A light pressure is sufficient.

Figure 4:
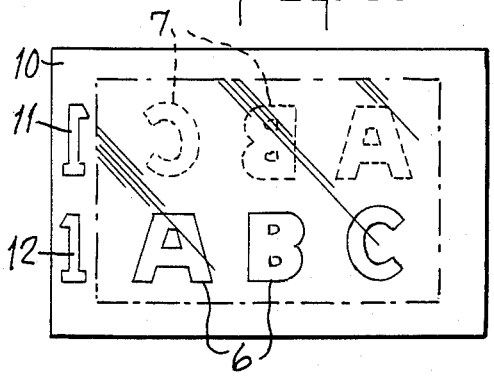
FIG. 4 is a plan view of a complete identification card constructed in accordance with the invention.

FIG. 4 shows a complete identification card constructed in accordance with the invention in which the marginal areas of the card have been made transparent by holding them for a longer period above the melting temperature of the normally opaque base layer. The card has letters 6 printed on the upper surface of the base sheet, which letters are readily visible. Another set of letters 7 is printed on the under surface of the base sheet and is shown in dotted lines, since it is not visible from the front. The marginal portions of the card shown at 10 have been made transparent so that a numeral 1 shown by the reference character 11, which is printed on the back of the base sheet, is also readily visible from the front. Another numeral 1, shown by the reference numeral 12, is printed on the front of the card and is, of course, visible. The transparency may, if desired, be extended over the whole card.

Figure 5:
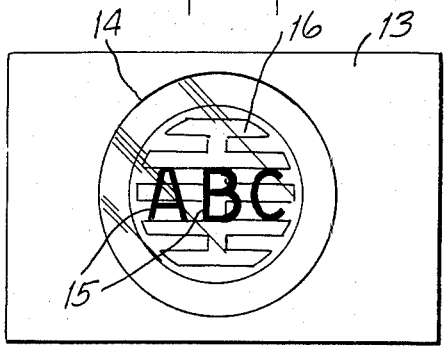
FIG. 5 is a plan view of a modified form of identification card.

FIG. 5 shows an identification card 13 in which a region 14 has been made transparent by an appropriate application of heat. Letters 15 on the front of the base sheet are of course visible, as well as a grid pattern 16 printed on the back of the base sheet. The transparentized region could cover the whole card or any part or parts thereof.

Figure 6:
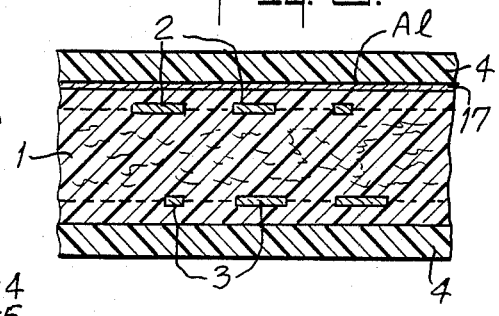
FIG. 6 is a figure similar to FIG. 3 showing a modified process for preparing an identification card.

FIG. 6 shows a modification in which a layer 17 of aluminum is deposited on the lower side of the Mylar layer 4. This aluminum layer 17 does not extend throughout the area of the card but only over selected areas. It preferably does not extend over the printed letters 2, since it would block those letters from being read.

Figure 7:
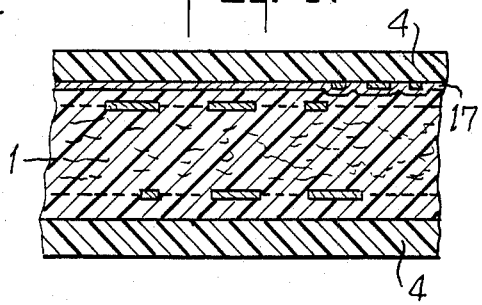
FIG. 7 is another figure similar to FIG. 3 but showing a further modification.

FIG. 7 is a further modification of FIG. 5 in which the Mylar layer 4 and the aluminum layer 17 are embossed. The embossing may take the form of a latent or transient image such as that shown in the patent to Hutton et al, U.S. Pat. No. 4,033,059. The embossing is preferably done after the Mylar has been coated with aluminum and before the polyethylene film is applied. Nevertheless, it is possible to do the embossing at any time before the protective sheets are joined to the base sheet.

In all the embodiments of the invention, the matrices formed by the bonded base sheet 1 and the films 5 are effective to encapsulate the markings on the base sheet, however they are applied. These matrices resist delamination at least as much as the base sheet, so that an attempt to delaminate the document to erase or change the marking results in a disruption of the base sheet and/or the film.

Other materials than polyethylene may be used, as described in U.S. Pat. No. 3,169,899, mentioned above. If a base sheet formed of film-fibrils is used, it must be bonded at its surfaces so that it will be printable.

It is not necessary that the film be of the same chemical composition as the base sheet, but only that the two materials be sufficiently compatible so that they fuse readily and respond similarly to attack by solvents or other chemicals.

Any type of printing may be used for marking the base sheet, including security lithographic and intaglio printing.

The base sheet need not necessarily be a film-fibril sheet, but may be another suitable material made from small pieces bonded together.

The security marking on the sheet may be printed, either lithographically, by an intaglio process, or by a xerographic process. The security marking may include a photograph so printed. It is undesirable to have a layer of photographic emulsion to receive the photograph, since such a layer is easily delaminated.

The base sheet may be "watermarked" by any convenient process so as to produce a visible marking on the sheet similar in appearance to a watermark. Such a "watermark" can be produced in a compressible sheet by embossing.

We claim:

1. A security document comprising:

a. a thermoplastic base sheet formed of film-fibrils bonded at its surfaces sufficiently to be receptive to printed markings thereon, said sheet having an internal structure less bonded than said surfaces;

b. security markings printed on at least one of said surfaces;

c. a layer of thermoplastic film having a melting temperature range overlapping the melting temperature range of the sheet material and having one surface fused directly to said one surface of the base sheet between the markings thereon, said layer forming with said one surface a matrix enclosing said security markings, said matrix having a delamination resistance greater than said internal structure; and d. a protective layer bonded to the opposite surface of the layer of film.

2. A security document as in claim 1, including:

(a) a second layer of film fused directly to the other surface of the sheet; and (b) a second protective layer bonded to the second layer of film.

3. A security document as in claim 2, including security markings on both surfaces of the base sheet and enclosed within matrices formed by the sheet and the layers of film.

4. A security document as in claim 1, in which the sheet and both layers in at least a portion of the document are transparent.

5. A security document as in claim 4, in which the sheet and both layers are transparent at least along one margin.

6. A security document as in claim 4, in which said transparent portion is within the document spaced from the edges thereof.

7. A security document as in claim 3, including a transparent area of the document including security markings on both sides of the sheet.

8. A security document as in claim 1, including a coating of aluminum on a portion of the surface of the protective layer nearest the film, said aluminum coating being laterally separated from the security markings.

9. A security document as in claim 8, including an embossing on the aluminum coated protective layer.

10. A method of making a security document, comprising:

a. marking spaced security indicia on the surface of a thermoplastic base sheet formed of film-fibrils, said sheet being bonded at its surfaces sufficiently to be receptive to said markings and having an internal structure less bonded than said surfaces;

b. covering the marked surface with a transparent layer of thermoplastic film having a melting temperature range overlapping the melting temperature range of said base sheet material; and c. fusing said transparent layer to the marked surface between the markings thereon to form a matrix enclosing the security indicia, said matrix having a delamination resistance greater than the internal structure of said sheet.

11. The method of claim 10, in which the sheet and the transparent layer are both polyethylene.

12. The method of claim 10, in which the layer is fused to the sheet by the application of heat and pressure.

13. The method of claim 10, in which the layer is fused to the sheet by radiant energy.

14. The method of claim 10, in which the softening temperature of the transparent layer is substantially the same as the softening temperature of the sheet.

15. The method of claim 10, in which at least some of the security indicia are marked on the surface by means of a xerographic toner.

16. The method of claim 10, including the further step of placing a protective layer over the transparent layer.

17. The method of claim 16, including the step of printing additional security indicia on the surface of the protective layer adjacent to the transparent layer.

18. The method of claim 16, including embossing additional security indicia on the protective layer.

19. A security document, comprising:

a. a thermoplastic base sheet formed of randomly overlapping continuous strands, each strand being a three-dimensional network of film-fibrils interconnected at random intervals along and across the strand, said film-fibrils at the surfaces of the sheet being well fused and of high density while the film-fibrils in the internal structure of the sheet are partially fused and of lower density;

b. security markings printed on at least one of said surfaces;

c. a layer of thermoplastic film having a melting temperature range overlapping the melting temperature range of the sheet material and having one surface fused directly to said printed surface of the base sheet between the markings thereon, said layer forming with said printed surface a matrix enclosing said security markings, said matrix having a delamination resistance greater than said internal structure, so that any attempt to delaminate the document results in a destruction of the base sheet; and d. a protective layer bonded to the opposite surface of the layer of film.

20. A method of making a security document, comprising:

a. marking spaced security indicia on the surface of a thermoplastic base sheet formed of randomly overlapping continuous strands, each strand being a three-dimensional network of film-fibrils interconnected at random intervals along and across the strand, the film-fibrils at the surfaces of the sheet being well fused and of high density, while film fibrils in the internal structure of the sheet are partially fused and of lower density;

b. covering the marked surface with a transparent layer of thermoplastic film having a melting temperature range overlapping the melting temperature range of the base sheet material; and c. fusing said transparent layer to the marked surface between the markings thereon to form a matrix enclosing the security indicia, said matrix having a delamination resistance greater than that of the internal structure of said sheet.

* * * * *